US006646496B2

(12) United States Patent
Watanabe

(10) Patent No.: US 6,646,496 B2
(45) Date of Patent: Nov. 11, 2003

(54) CURRENT CONTROL CIRCUIT

(75) Inventor: Shinichi Watanabe, Tokyo (JP)

(73) Assignee: Nippon Precision Circuits Inc., Tokyo (JP)

( * ) Notice: Subject to any disclaimer, the term of this patent is extended or adjusted under 35 U.S.C. 154(b) by 0 days.

(21) Appl. No.: 10/166,819

(22) Filed: Jun. 11, 2002

(65) Prior Publication Data

US 2003/0006827 A1 Jan. 9, 2003

(30) Foreign Application Priority Data

Jun. 28, 2001 (JP) ..... 2001-195936

(51) Int. Cl.[7] ..... G05F 3/24; G05F 3/26
(52) U.S. Cl. ..... 327/541; 327/543; 323/314
(58) Field of Search ..... 327/538, 540, 327/541, 543, 108, 109; 323/312–316

(56) References Cited

U.S. PATENT DOCUMENTS 5,059,890 A * 10/1991 Yoshikawa et al. ..... 327/541
6,275,100 B1 * 8/2001 Park et al. ..... 327/543
6,348,835 B1 * 2/2002 Sato et al. ..... 327/543
6,496,049 B2 * 12/2002 Tsukagoshi et al. ..... 327/538

* cited by examiner

*Primary Examiner*—Timothy P. Callahan
*Assistant Examiner*—Terry L. Englund
(74) *Attorney, Agent, or Firm*—Jordan and Hamburg LLP

(57) ABSTRACT

A current control circuit for maintaining constant current characteristics with respect to power source potential fluctuations has a first resistor with one end connected to a source potential first and second P-channel field effect transistors each having a source connected to the other end of the first resistor and a gate coupled to a gate of the other P-channel FET. The first P-channel FET has a drain directly connected to the mutually coupled gates. A second resistor connects a drain of the second P-channel FET to the mutually coupled gates, and a resistor element connects the mutually coupled gates to a zero potential. A voltage arising at the drain of the second P-channel FET is used as a gate-driving voltage for driving a gate of a current-setting transistor.

8 Claims, 19 Drawing Sheets

PRIOR ART

PRIOR ART

PRIOR ART

CURRENT CONTROL CIRCUIT

BACKGROUND OF THE INVENTION

1. Field of the Invention

The present invention relates generally to a current control circuit and more particularly to a current control circuit comprising field-effect transistors capable of controlling currents even if the power source potential fluctuates sharply.

2. Description of the Related Art

It is known that field-effect transistor bias voltage supply circuits, as shown in FIGS. 16, 18, have been used to determine currents in the art. In the bias voltage supply circuits shown in FIGS. 16, 18, the current-voltage characteristics between the source and drain of a field-effect transistor having the gate and drain connected together are utilized. The characteristics of such circuits deviate from the constant voltage characteristics with an increase in the current. In other words, from the transistor characteristics it can be said for bias voltage generator circuits shown in FIGS. 16, 18 that a transistor having the drain and the gate connected together has the characteristic that the drain-source voltage increases with an increase in drain current based on the drain-source voltage characteristics of a saturation region in a case that the gate and drain of the transistor are connected. The bias circuits of FIGS. 16, 18 are applied to conventional operational amplifiers 3A, 3A illustrated in FIGS. 17, 19. The conventional operational amplifiers 3A, 3A illustrated in FIGS. 17 and 19 are the same as that of which details are mentioned below with reference to FIG. 4. The bias voltages at terminals 20, 20' of FIGS. 16 and 18 are supplied to gates of P-channel field-effect transistors MP14 and MP15 setting currents flowing in the operational amplifiers 3A, 3A of FIGS. 17 and 19, wherein the transistors MP14 and MP15 supply and set the current to a differential input portion comprising transistors MP12, MP13, MN8 and MN9 and an output portion comprising a transistor MN10, respectively. The, circuit currents i10 and i510 of the operational amplifiers 3A, 3A depend on the respective power source voltages VDDs as i10 of FIG. 6 and i510 of FIG. 7, and increase with an increase in the power source voltage. This presents the problem that the performances of the operational amplifiers shown in FIGS. 17, 19 according to the related art can be assured only in a narrow range of power source voltages. More specifically, when the conventional voltage generator circuit for providing constant current in combination with a transistor with a realistic channel width and channel length is used as a constant current source for an amplifier, the circuit current increases with an increase in the power source voltage, resulting in large fluctuations of the frequency response and stability margin. This causes the problem that the operational range of the power source potential is narrowed.

In addition, such conventional constant current circuits are disclosed in Japanese Patent Laid-Open No. 42717/1989 and Japanese Patent Laid-Open No. 91166/1993. The constant current circuits disclosed in these unexamined publications have had the problem that it is more difficult to obtain the constant current characteristics in low voltage range of twice to several times the voltage of the threshold Vth of a transistor to be used compared to a higher power source voltage range.

According to one aspect of the invention, it is an object of the invention to provide a current control circuit capable of maintaining constant current characteristics with respect to a wide range of power source potential fluctuations.

According to another aspect of the invention, it is another object of the invention to provide a current control circuit for use in an amplifier of which a stable performance is required even if large fluctuations of a power source voltage in use arise in the circuit wherein a battery is used as an electric source depending on the degree of consumption of the battery.

Furthermore, in the conventional circuit, the fluctuation property of current shows monotonous straight-line form when constant current circuits are connected in the multi-stage form, so that it is impossible to provide the characteristic that power source voltage fluctuations are canceled out and the combined characteristic that circuit current goes up first and later down with respect to the source voltage. Therefore, circuit current has not been maintained within a given range regardless of the source voltage fluctuations with the use of the combined characteristic.

According to a still further aspect of the invention, it is an object of the invention to provide a current control circuit having a nonlinear output characteristic with respect to power source voltage fluctuations.

In addition, according to even further aspect of the invention, it is an object of the invention to provide a current control circuit with desired characteristics and large design freedom so that it can be constituted by combining transistors each having the realistic channel width and channel length.

SUMMARY OF THE INVENTION

To solve the problems and achieve the objects, according to the invention, there is provided a current control circuit comprising: a first resistor with one end connected to a power source potential; first and second P-channel field-effect transistors, each of which having a source connected to the other end of the first resistor and a gate coupled to a gate of the other P-channel field-effect transistor, the first P-channel field-effect transistor having a drain directly connected to both the gates coupled together; a second resistor through which a drain of the second P-channel field-effect transistor is connected to both the gates coupled together; and a resistor element through which both the gates coupled together are connected to a zero potential, wherein a voltage arising at the drain of the second P-channel field-effect transistor is used as a gate-driving voltage for driving a gate of a current-setting transistor.

The current control circuit may be used in combination with their one or more equivalents. In addition, the resistor element may comprise transistors constituting a current mirror circuit for duplicating a current flowing through a current-setting transistor which receives a driving voltage from one of the current control circuits used for a pre-stage.

Furthermore, according to the invention, there is provided a current control circuit comprising: a first resistor with one end connected to a zero potential; first and second N-channel field-effect transistors, each of which having a source connected to the other end of the first resistor and a gate coupled to a gate of the other N-channel field-effect transistor, the first N-channel field-effect transistor having a drain directly connected to both the gates coupled together; a second resistor through which a drain of the second N-channel field-effect transistor is connected to both the gates coupled together; and a resistor element through which both the gates coupled together are connected to a power source potential, wherein a voltage arising at the drain of the second N-channel field-effect transistor is used as a gate-driving voltage for driving a gate of a current-setting transistor.

The current control circuit may be used in combination with their one or more equivalents. In addition, the resistor element may comprise transistors constituting a current mirror circuit for duplicating a current flowing through a current-setting transistor which receives a driving voltage from one of the current control circuits used for a pre-stage.

The current control circuits according to the invention can maintain current consumption of the circuit constant even if the operating power source potential range is widened, so that it is useful for amplifiers. In other words, it is possible to provide a current control circuit capable of maintaining a fixed performance over a wide range of the power source potential.

A combination of the current control circuits according to the invention has the characteristic that the current consumption goes up first and later down with an increase in the power source potential instead of the linear characteristic that the current consumption monotonously increases with an increase in the power source potential, whereby better control of current consumption can be provided than conventional current control circuits.

In addition, according to the invention, there is provided a current control circuit in combination with a current control circuit of the opposite conductivity type. A resistor element thereof may include the current-setting transistor, which receives the driving voltage from the pre-stage current control circuit.

Therefore, with the current control circuit according to the invention, it is possible to provide a current control circuit for maintaining constant current characteristics with respect to a wide range of power source potential fluctuations. Further, according to the invention, it is also possible to provide an amplifier capable of achieving stable performance even if large fluctuations of a power source voltage in use arise in the circuit wherein a battery is used as an electric source depending on the degree of consumption of the battery. Also, according to the invention, it is possible to provide a current control circuit having the fluctuation characteristic that circuit current goes up first and later down with an increase in the source potential, and the nonlinear output characteristic with respect to the power source voltage fluctuations, whereby a current fluctuation range can be reduced. In addition, according to the invention, it is possible to provide a current control circuit with desired characteristics and large design freedom so that it can be constituted by combining transistors each having the realistic channel width and channel length.

DESCRIPTION OF THE PREFERRED EMBODIMENTS

Figure 1:
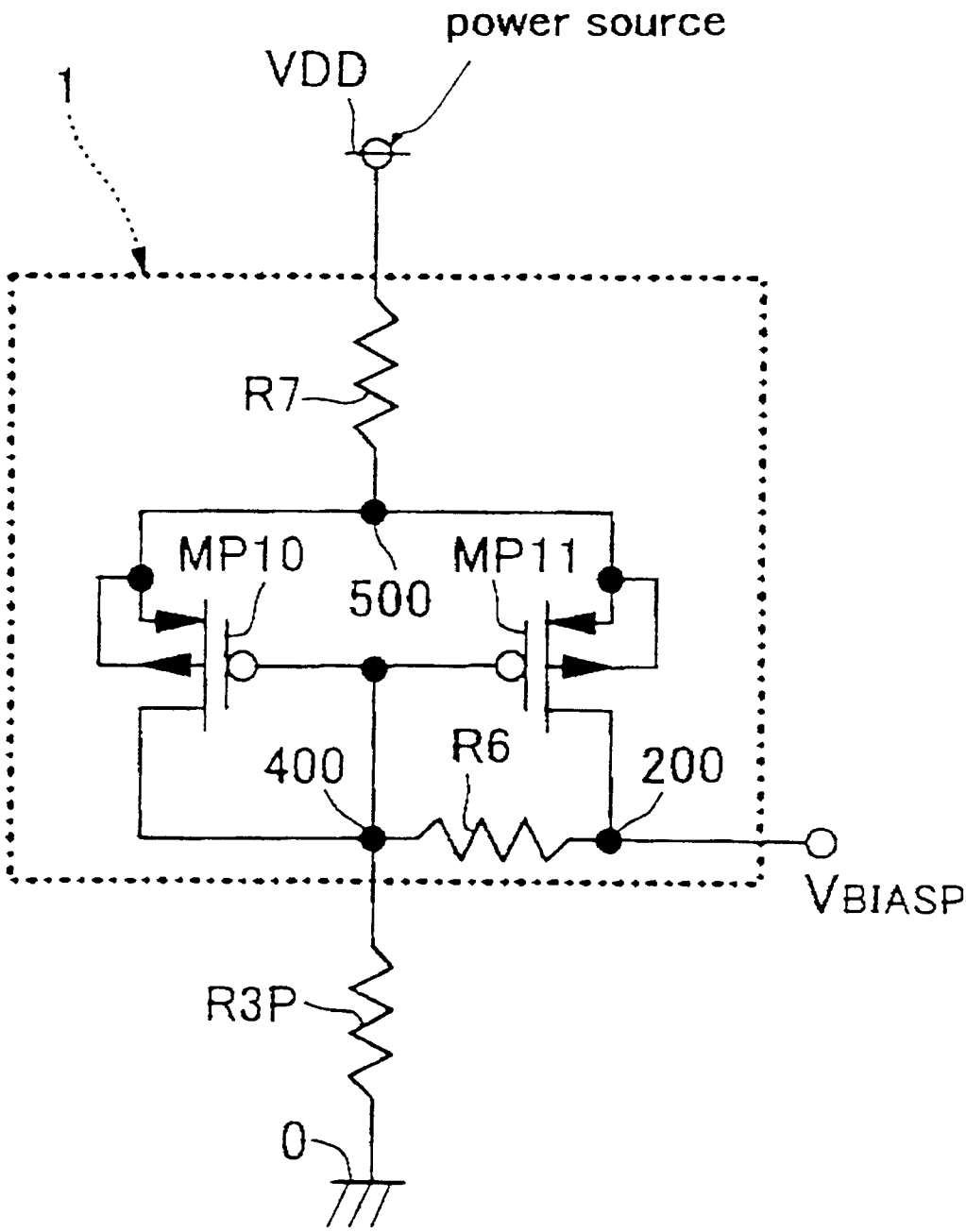
FIG. 1 is a circuit diagram of a current control circuit according to the first embodiment of the invention.

Specific circuits according to the preferred embodiments of the invention will be described in detail below with reference to the accompanying drawings, wherein like reference numerals designate like or corresponding components in the circuits to avoid repeated descriptions.

FIG. 1 shows the first preferred embodiment of the invention in the form of a current control circuit wherein a P-type substrate is used. In FIG. 1, VDD shows a power source potential provided by an electric source such as a battery; and 0 shows the zero potential. The current control circuit according to the embodiment is placed between the power source potential VDD and zero potential 0. More specifically, the current control circuit 1 according to the embodiment has a first resistor R7 with one end thereof connected to the power source potential VDD and first and second P-channel field-effect transistors MP10, MP11, each having a source connected to a node 500 at the other end of the first resistor R7 opposite from the end connected to the power source potential VDD and a gate coupled to a gate of the other P-channel field-effect transistor.

The drain of the first P-channel field-effect transistor MP10 is directly connected to a node 400 that is connected to the mutually coupled gates of the first and second P-channel field-effect transistors MP10, MP11. The drain of the second P-channel field-effect transistor MP11 is connected to a second resistor R6 at a node 200, and therethrough at the node 400 connected to the mutually coupled gates of the first and second P-channel field-effect transistors MP10, MP11. In addition, the mutually coupled gates of the first and second P-channel field-effect transistors MP10, MP11 are connected to a resistor element R3P at the node 400 and to the zero potential therethrough.

Figure 2:
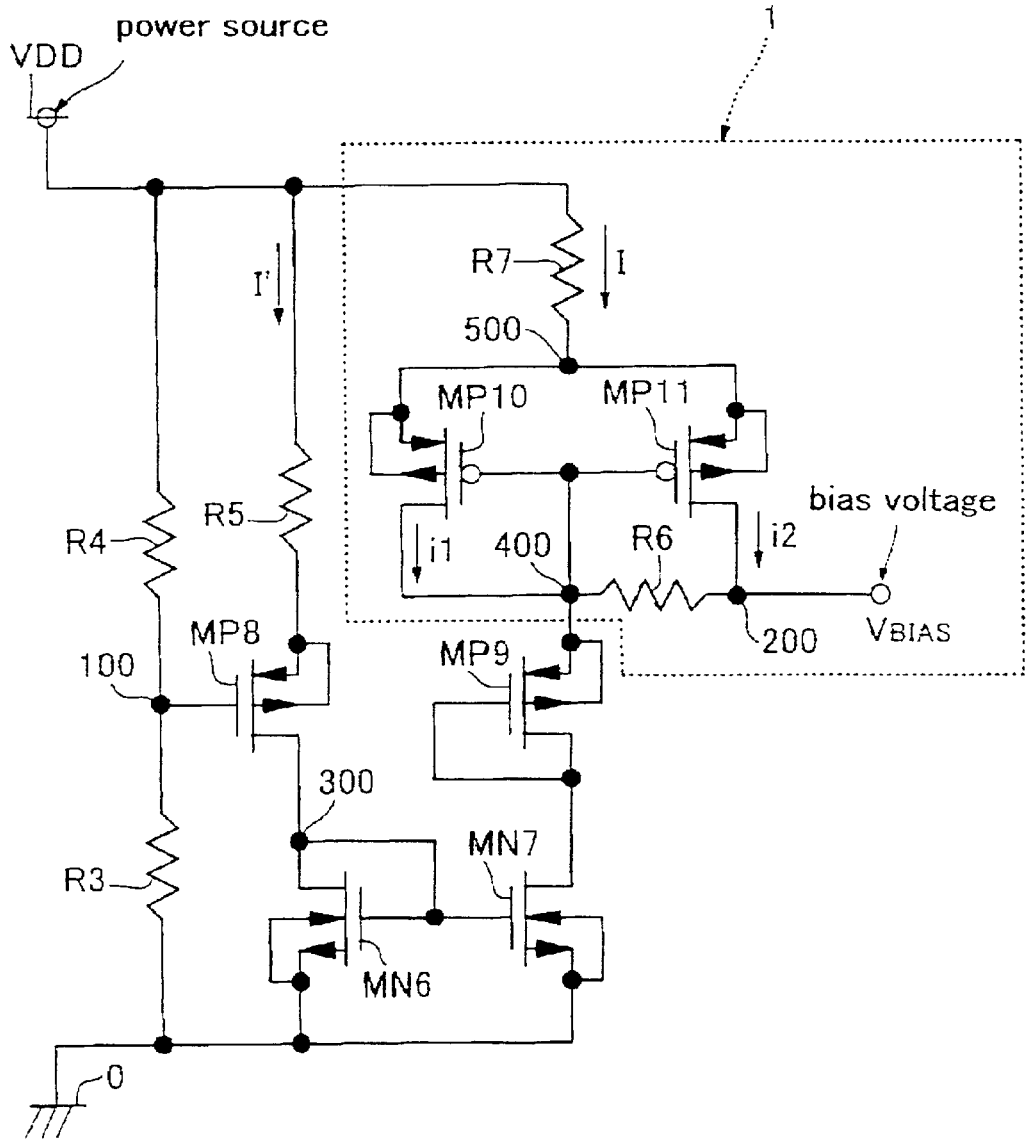
FIG. 2 is a circuit diagram of an application circuit of the circuit of FIG. 1 according to another embodiment of the invention.

A voltage $V_{BIASP}$ arising at the node 200 connected to the drain of the second P-channel field-effect transistor MP11 is used as a bias potential, whereby a current control circuit having constant current characteristics over a wide range of source voltages can be produced, as described hereinbelow FIG. 2 shows an application circuit of the circuit of FIG. 1. The characteristics of the circuit shown in FIG. 1 are described with reference to FIG. 2. In the circuit of FIG. 2, the resistor element R3P of FIG. 1 is replaced with a P-channel field-effect transistor MP9 and an N-channel field-effect transistor MN7 placed in series. In this arrangement, the P-channel field-effect transistor MP9 has a gate and drain connected together; and the N-channel field-effect transistor MN7 has a drain connected to the drain of the transistor MP9, a source connected to the zero potential 0, and a gate coupled to a gate of an N-channel field-effect transistor MN6 with a source connected to the zero potential 0. In addition, the gate and drain of the N-channel field-effect transistor MN6 are coupled to a drain of a P-channel field-effect transistor MP8 at a node 300. The source of the P-channel field-effect transistor MP8 is connected to the power source potential VDD through a resistor R5, and a gate of the P-channel field-effect transistor MP8 is connected to a node 100 which is located at the midpoint between resistors R4, R3. The terminal of the resistor R4 opposite from the midpoint node 100 is connected to the power source potential VDD and the terminal of the resistor R3 opposite from the midpoint node 100 is connected to the zero potential 0.

In FIG. 2, I is current flowing through a first resistor R7; I' is current flowing through the resistor R5; i1 is current flowing through the drain of the first P-channel field-effect transistor MP10; and i2 is current flowing through MP11. The drain of the second P-channel field-effect transistor MP11. The potential-current relationship at the nodes 200, 400 in FIG. 2 is described with the equation hereinbelow. The transistors MP10, MP11 operate in their saturation regions, thus the following four equations (1) to (4) hold.

$$i_1 = \frac{1}{2}\beta_0 \frac{W_{MP10}}{L_{MP10}}(V400 - VDD + R7 \cdot I - V_{thp})^2 \tag{1}$$

$$i_2 = \frac{1}{2}\beta_0 \frac{W_{MP11}}{L_{MP11}}(V200 - VDD + R7 \cdot I - V_{thp})^2 \tag{2}$$

$$i_2 = \frac{V200 - V400}{R6} \tag{3}$$

$$I = i_1 + i_2 \tag{4}$$

where:

$$\beta_0 = \mu_0 * C_{OX} = \mu_0(e_{OX}/t_{OX})$$

$\mu_0$: density of carriers;

$e_{OX}$: dielectric constant of gate oxide film;

$t_{OX}$: gate oxide film thickness;

$V_{thp}$: threshold voltage of P-channel transistor;

$V_{thn}$: threshold voltage of N-channel transistor;

L: channel length;

$L_{MN6}$: channel length of transistor MN6;

$L_{MP10}$: channel length of transistor MP10;

$L_{MP11}$:channel length of transistor MP11;

W: channel width;

$W_{MN6}$: channel width of transistor MN6;

$W_{MP10}$:channel width of transistor MP10;

$W_{MP11}$:channel width of transistor MP11; and

VDD: power source voltage.

Now, if current I is expressed by a power source voltage VDD and constants, then $$I = I' = \frac{1}{R^5}\left\{\frac{\sqrt{\frac{W_{MN6}}{L_{MN6}}} \times (V300 - V_{thn})}{\sqrt{\frac{W_{MPS}}{L_{MPS}}}} - \frac{1}{2}VDD + V300 + V_{thp}\right\} \tag{5}$$

In addition, the following relationships hold.

$$R3 = R4 \tag{6}$$

$$R6 \cdot I - \frac{1}{2}\beta_0 \frac{W_{MP11}}{L_{MP11}} \cdot R7(V200 - VDD + R7 \cdot I - V_{thp}) = \frac{1}{2}\beta_0 \frac{W_{MP10}}{L_{MP10}} \cdot R6\left[\{(V200 - VDD + R7 \cdot I \cdot V_{thp})^2\}^2 - 2(V200 - VDD + R7 \cdot I - V_{thp})^2 (VDD + V_{thp} - R7 \cdot I) + (VDD + V_{thp} - R7 \cdot I)^2\right] \tag{7}$$

-continued $$
\begin{aligned}
0 = & -\frac{1}{2}\beta_0\frac{W_{MP11}}{L_{MP11}}\cdot R7\cdot V200^4 + \\
& 2\cdot\beta_0\frac{W_{MP10}}{L_{MP10}}\cdot R7(V_{thp} - R6\cdot I - VDD)V200^3 + \\
& [\beta_0\{2(3\cdot R6\cdot I\cdot V_{thp} + 3\cdot VDD\cdot R6\cdot I + 2VDD\cdot V_{thp}) - \\
& (V_{thp}^2 + 3VDD^2 + R6^2 I^2) + (VDD + V_{thp} + R6\cdot I)\} - \\
& \frac{1}{2}\beta_0\frac{W_{MP11}}{L_{MP11}}\Big]V200^2 + \Big[2\beta_0\frac{W_{MP10}}{L_{MP10}}\{VDD(VDD(VDD + \\
& 3\cdot R6\cdot I - V_{thp}) + V_{thp}(V_{thp} + R6^2 I^2 - R6\cdot I)) + \\
& R6\cdot I(2\cdot R6\cdot I - V_{thp})\} + \\
& \beta_0\frac{W_{MP11}}{L_{MP11}}(VDD - R6\cdot I - V_{thp})\Big]V200 + \\
& R7\cdot I - \frac{1}{2}\beta_0\frac{W_{MP11}}{L_{MP11}}(VDD^2 + V_{thp}^2) + \beta_0\frac{W_{MP11}}{L_{MP11}}\cdot R6\cdot \\
& I(VDD + V_{thp}) - \frac{1}{2}\beta_0\frac{W_{MP10}}{L_{MP10}}(VDD^4 + R6^4 I^4 + V_{thp}^4) + \\
& \beta_0\frac{W_{MP10}}{L_{MP10}}R6^2 I^2\{R6\cdot I(V_{thp} - 2\cdot VDD) - 2(VDD^2 + V_{thp}^2) - \\
& (2\cdot VDD\cdot V_{thp}) + 2\} - \beta_0\frac{W_{MP10}}{L_{MP10}}V_{thp}\{R6\cdot I(VDD + V_{thp}) + \\
& (V_{thp}^2 - 2\cdot R6\cdot I)\} + \beta_0\frac{W_{MP10}}{L_{MP10}}VDD^3 + \\
& \beta_0\frac{W_{MP10}}{L_{MP10}}VDD^2(V_{thp} + R6\cdot I) + \\
& \beta_0\frac{W_{MP10}}{L_{MP10}}VDD\{V_{thp}^2 + R6\cdot I(V_{thp} - 2)\}
\end{aligned}
\tag{8}
$$

If Equation (5) is substituted into Equation (8) to remove current I in Equation (8), a potential V200 can be expressed by a biquadratic function in connection with the power source voltage and the transistor sizes.

Figure 3:
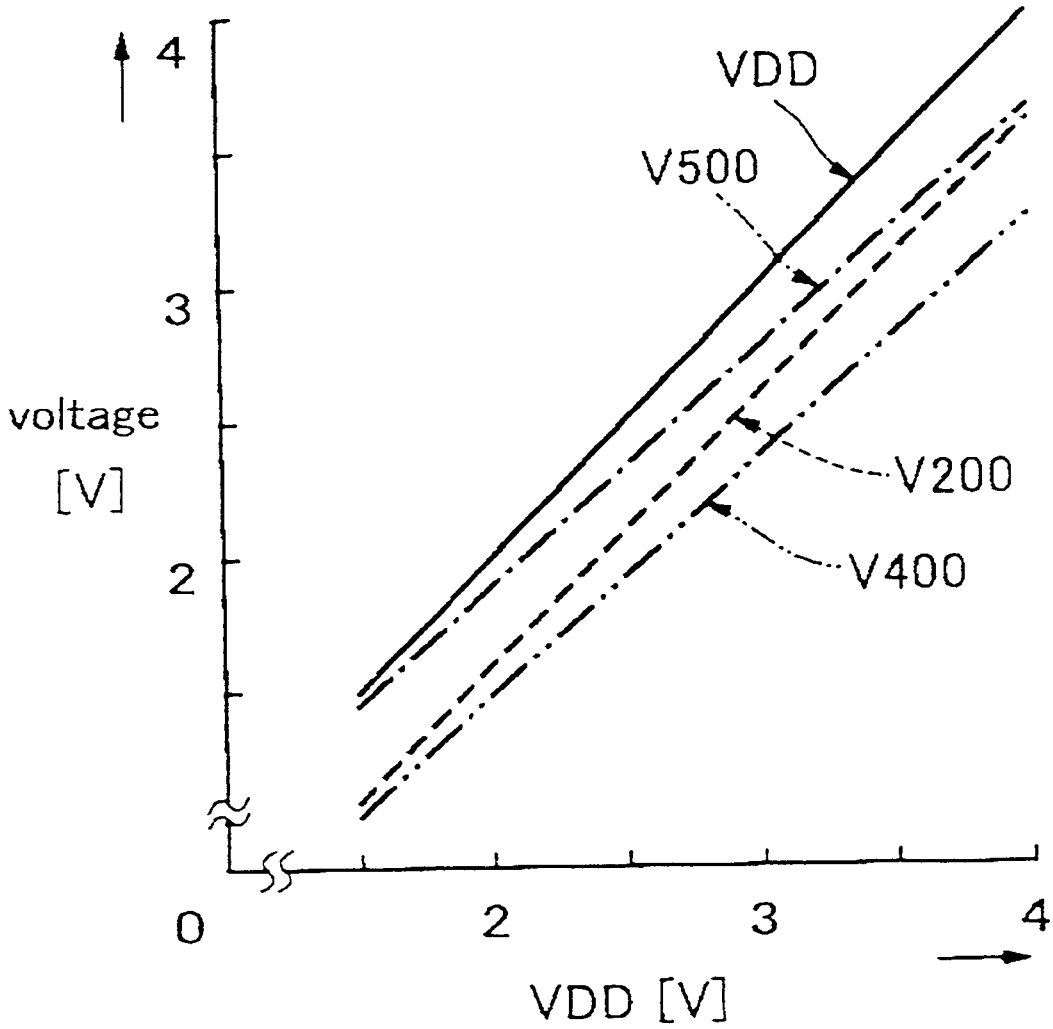
FIG. 3 is a graph for comparison of the nodes shown in FIG. 2, wherein the horizontal axis shows values of the power source potential VDD, and the vertical axis shows voltage values at the nodes of FIG. 2.

Relationships between voltages at the nodes 200, 400, and 500, and the power source voltage VDD in the circuit of FIG. 2 are as expressed by graphs of FIG. 3. For instance, when current I flows, a voltage drop of (I×R7) arises at the node 500. From the node 500 to the node 400, current I is diverted into two paths, one comprising the transistor MP10 and the other comprising the transistor MP11. The currents flowing through the two paths are represented as i1 and i2 respectively. In this case, increasing the VDD increases a potential difference between VDD and V500 monotonously. Also, as for a potential difference between V500 and V400, increasing the VDD increases drain current of the transistor MP10, thereby increasing a potential difference between the gate and source of the transistor MP10 because of the characteristics of the transistor having the gate and drain connected together. Use of a potential difference between the gate and source of the transistor MP10 to activate the gate of the transistor MP11 allows control of current flowing through the transistor MP11. Because current passing through the transistor MP11 increases with an increase in VDD, it can be used as a nonlinear resistor to improve convergence of the upper limit of a source voltage range for the purpose of use with a constant current consumption. With the use of such characteristics, the channel length and channel width of the first field-effect transistor MP10, the channel length and channel width of the second field-effect transistor MP11, the constant of the first resistor R7, and the constant of the second resistor R6 are selected, whereby it becomes possible to constitute a circuit insensitive to current I for holding a constant potential according to a biquadratic function including a cubic function as its predominating factor to produce a voltage of the node 200, namely V200, which is maintained stable even when a source voltage VDD fluctuates. The characteristic curve of the so-utilized transistor has shown that its current consumption does not monotonously increase but goes up first and later down with an increase in power source voltage VDD. Therefore, it becomes possible to suppress changes in current consumption in the circuit better than in conventional ones.

Figure 4:
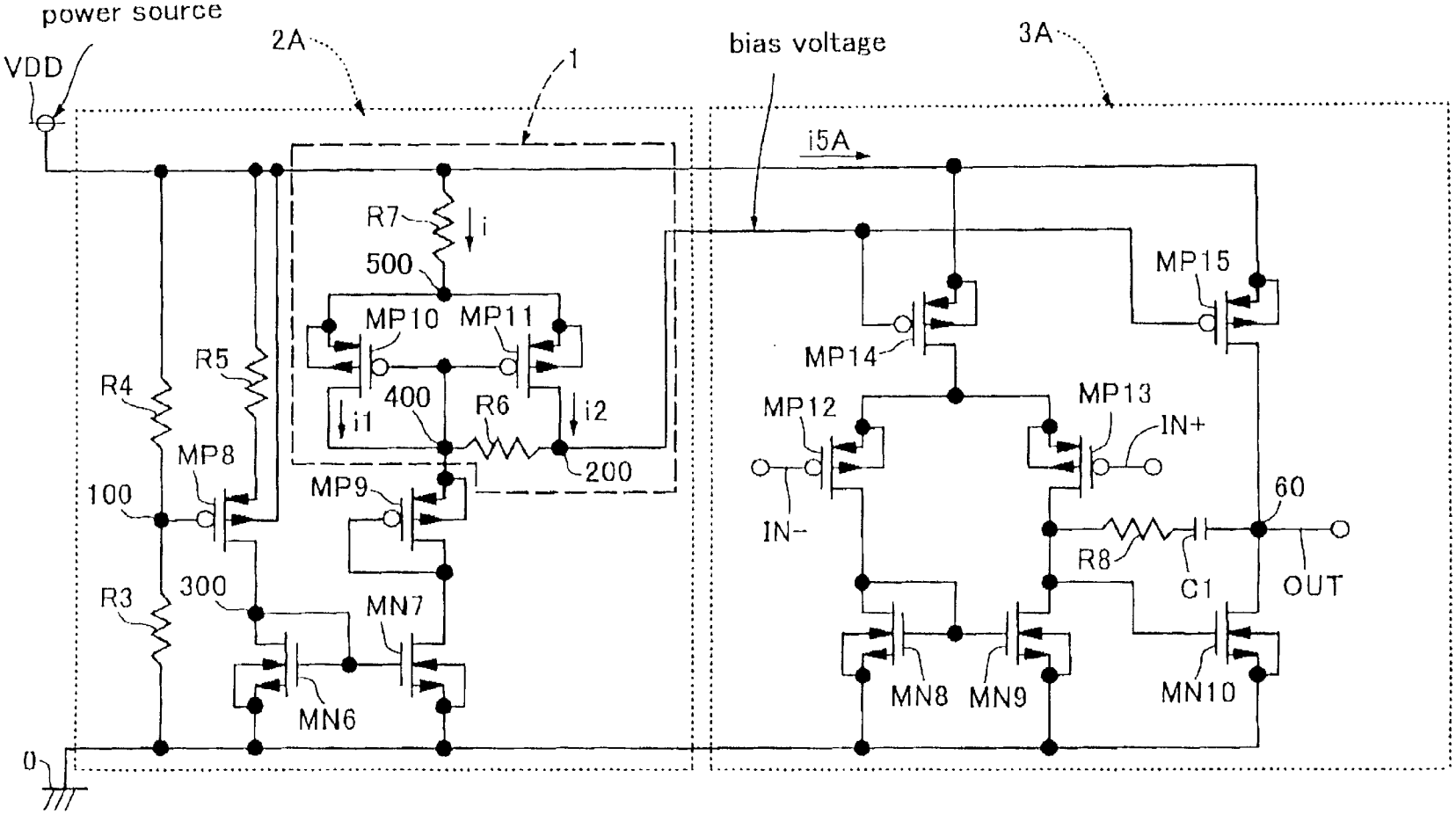
FIG. 4 is a circuit diagram of an application circuit of the circuit of FIG. 2 according to another embodiment of the invention.

FIG. 4 shows an operational amplifier circuit having two amplifier stages wherein the bias circuit shown in FIG. 2 according to the embodiment is incorporated. More specifically, the left side of FIG. 4 shows the bias circuit 2A previously described with reference to FIG. 2; and the right side thereof shows an operational amplifier circuit 3A. The amplifier circuit 3A comprises P-channel field-effect transistors MP14, MP15, each having a source connected to a power source potential VDD and a gate connected to a node 200 at a bias voltage. The drain of the transistor MP14 is connected to sources of a pair of P-channel transistors MP12, MP13. The gate of the P-channel transistor MP12 receives operational amplifier cold inputs IN-, and a gate of the P-channel transistor MP13 receives operational amplifier hot inputs IN+. The drain of the P-channel transistor MP12 is connected to the drain and the gate of an N-channel transistor MN8. The drain of the P-channel transistor MP13 is connected to the drain of an N-channel transistor MN9 and the gate of an N-channel transistor MN10. The drain of the P-channel transistor MP12 is also connected to the gate of the N-channel transistor MN9. The sources of the N-channel transistors MN8, MN9, and MN10 are connected to the zero potential. The drain of the P-channel transistor MP15 is connected to the drain of the N-channel transistor MN10 through a node 60. The node 60 is connected to the drain of the P-channel transistor MP13 through a capacitor C1 and a resistor R8. The node 60 forms an output terminal of the operational amplifier.

According to the advantageous effects of the circuit of the invention shown in FIG. 2, it becomes readily possible to make circuit current i5A of this operational amplifier constant regardless of the power source voltage VDD. When the circuit of the invention is used to determine a transistor size of the two-stage operational amplifier 3A, the power source potential VDD and potentials at the nodes 200, 400, and 500 in FIG. 4 are as shown in FIG. 3.

Figure 5:
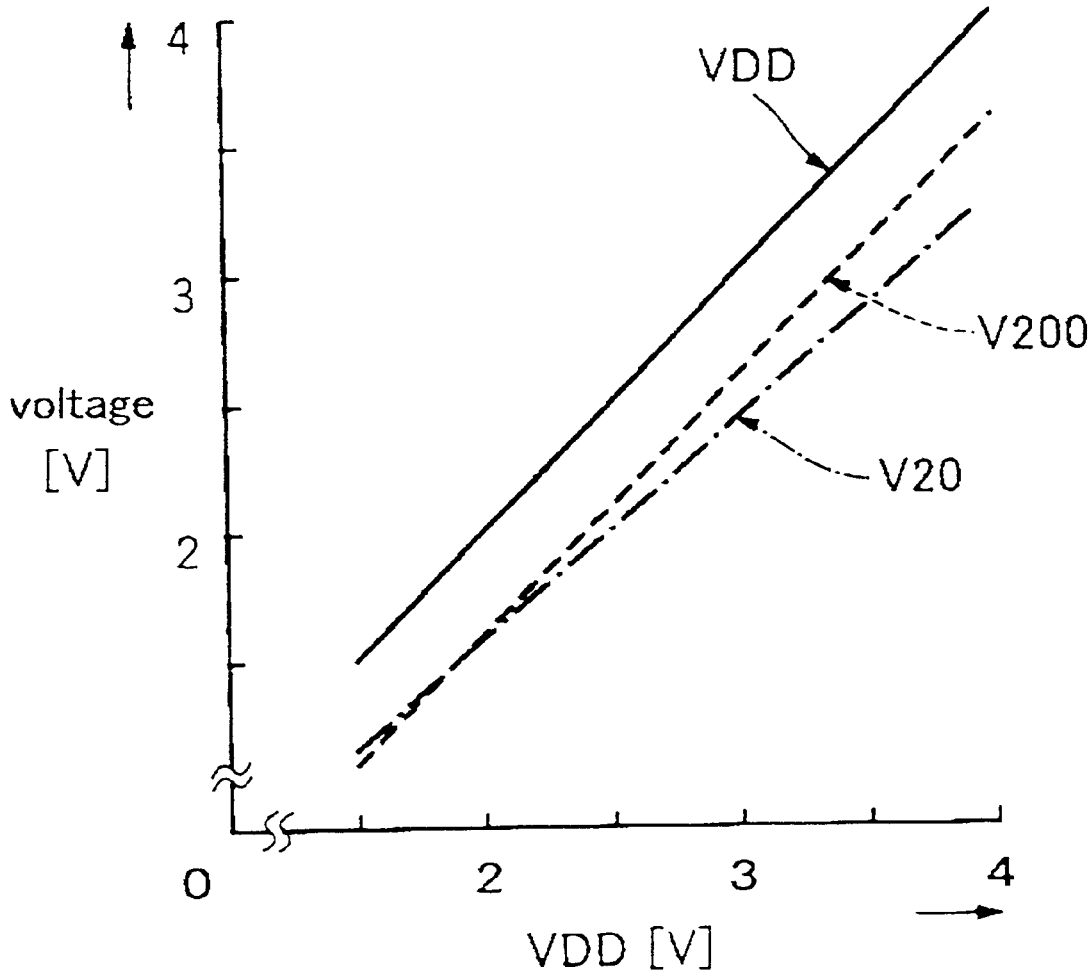
FIG. 5 is a graph for comparison of the circuit of FIG. 4 and the conventional circuit of FIG. 17, wherein the horizontal axis shows values of the power source potential VDD, and the vertical axis shows voltage values at the nodes shown in FIGS. 4, 17.
Figure 6:
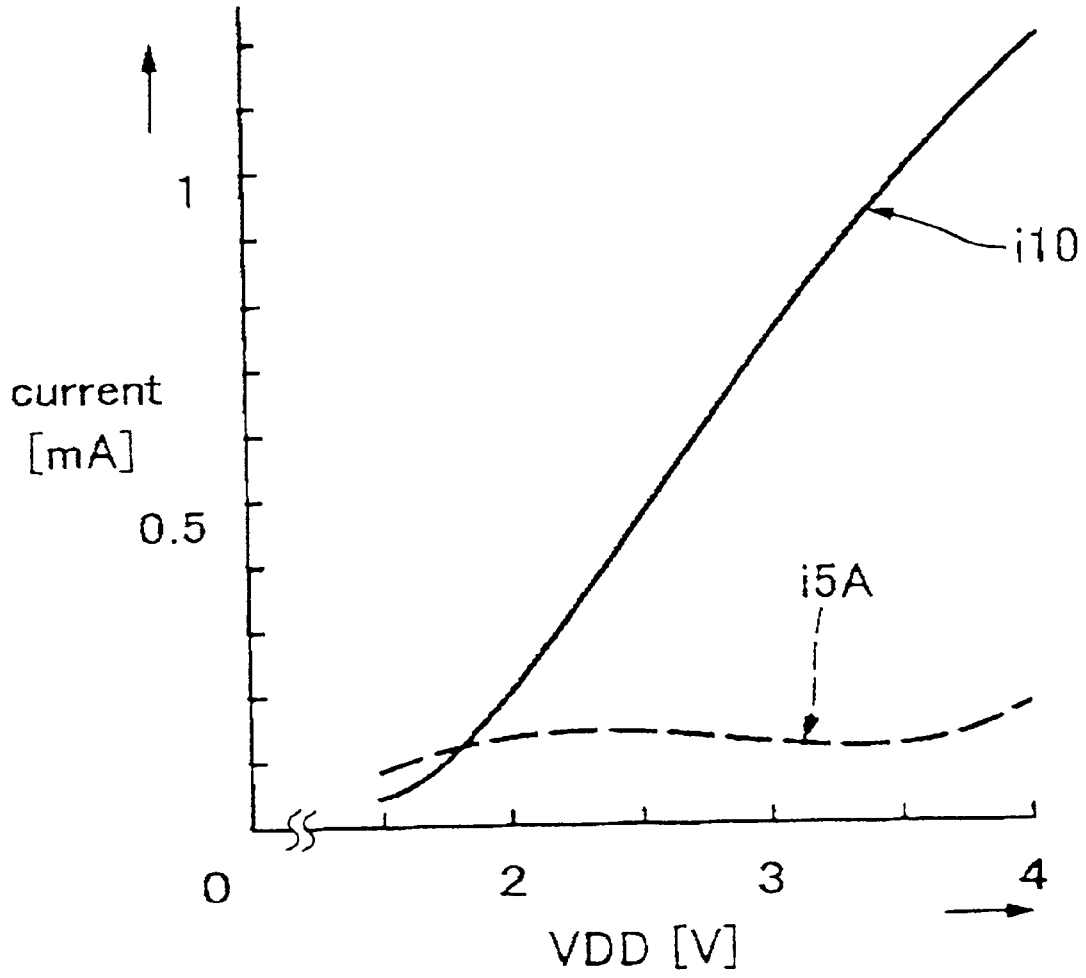
FIG. 6 is a graph for comparison of the circuit of FIG. 4 and the conventional circuit of FIG. 17, wherein the horizontal axis shows values of the power source potential VDD, and the vertical axis shows values of currents in the circuits of FIGS. 4, 17.
Figure 16:
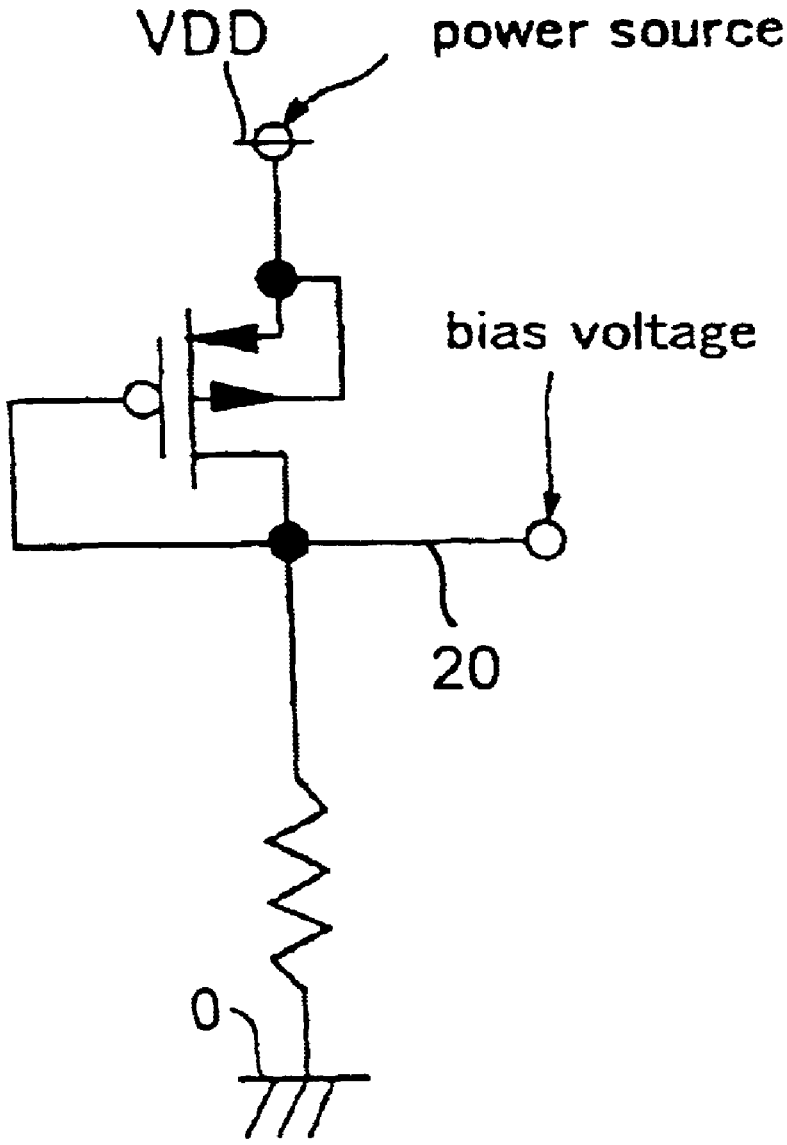
FIG. 16 is a circuit diagram of a conventional current control circuit corresponding to FIG. 1.
Figure 17:
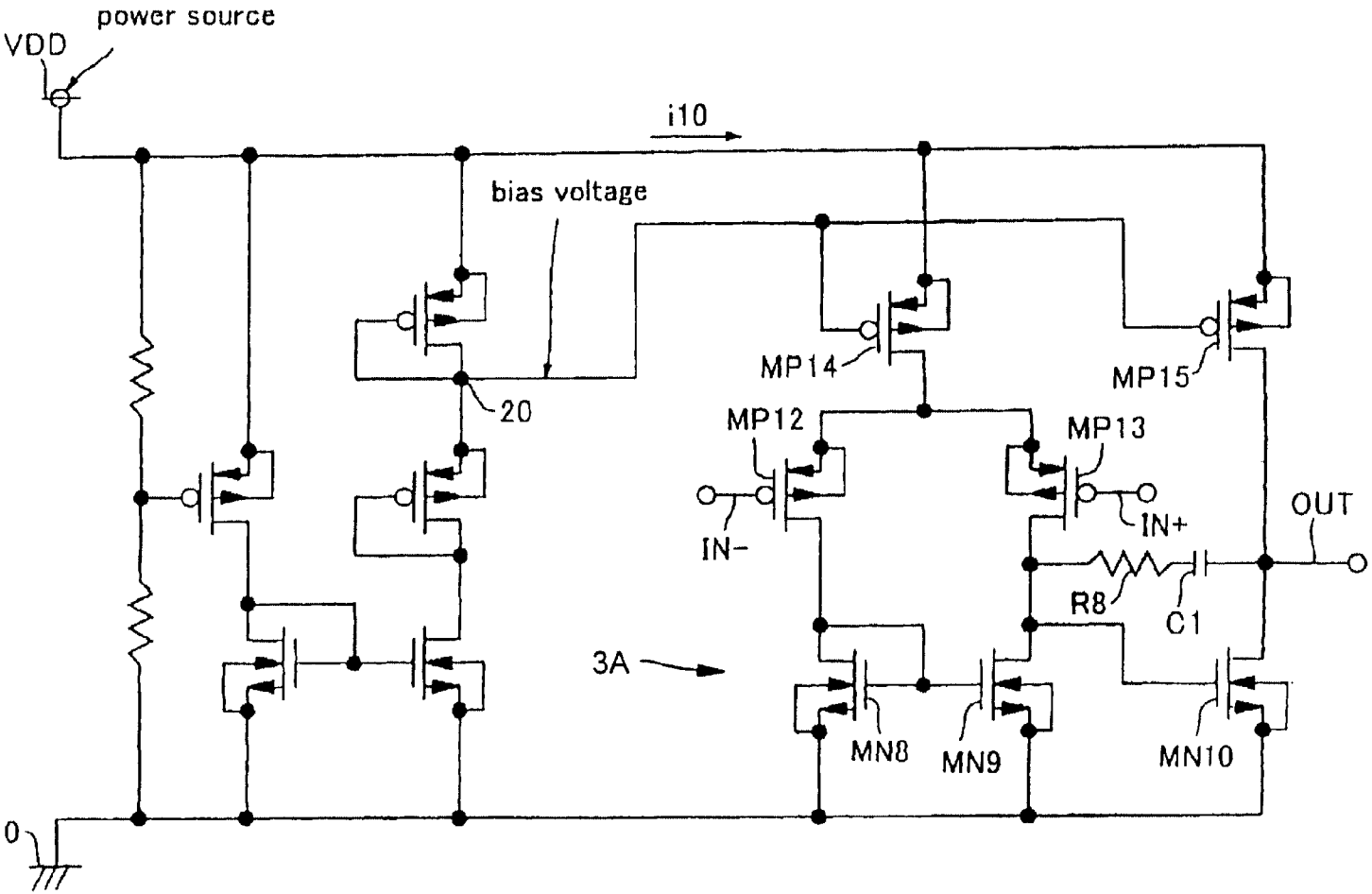
FIG. 17 is a conventional circuit diagram corresponding to FIG. 4.

For comparison purposes, FIG. 5 provides plots of potential V200 at the node 200 of the circuit in the embodiment of FIG. 4, and bias voltage V20 at the node 20 when a conventional bias circuit (FIG. 16) is applied to the same operational amplifier 3A as shown in FIG. 17. In the circuit of FIG. 4 according to the invention, a bias potential at node 200 with respect to the power source potential VDD follows a curve represented by a biquadratic function including a cubic function as its predominating factor. Consequently, as shown in FIG. 6, particularly when the power source potential VDD is very low, unlike the conventional circuit of FIG. 17 having the characteristic that current consumption thereof increases with an increase in the source voltage VDD simply as shown by current i10, the circuit of FIG. 4 has the characteristic that current consumption thereof changes as shown by current i5A, for example, temporarily decreases in a part of VDD range with an increase in the power source voltage VDD. Thus, changes in current consumption in the circuit of FIG. 4 can be reduced in a range of power source voltages to be used.

Figure 7:
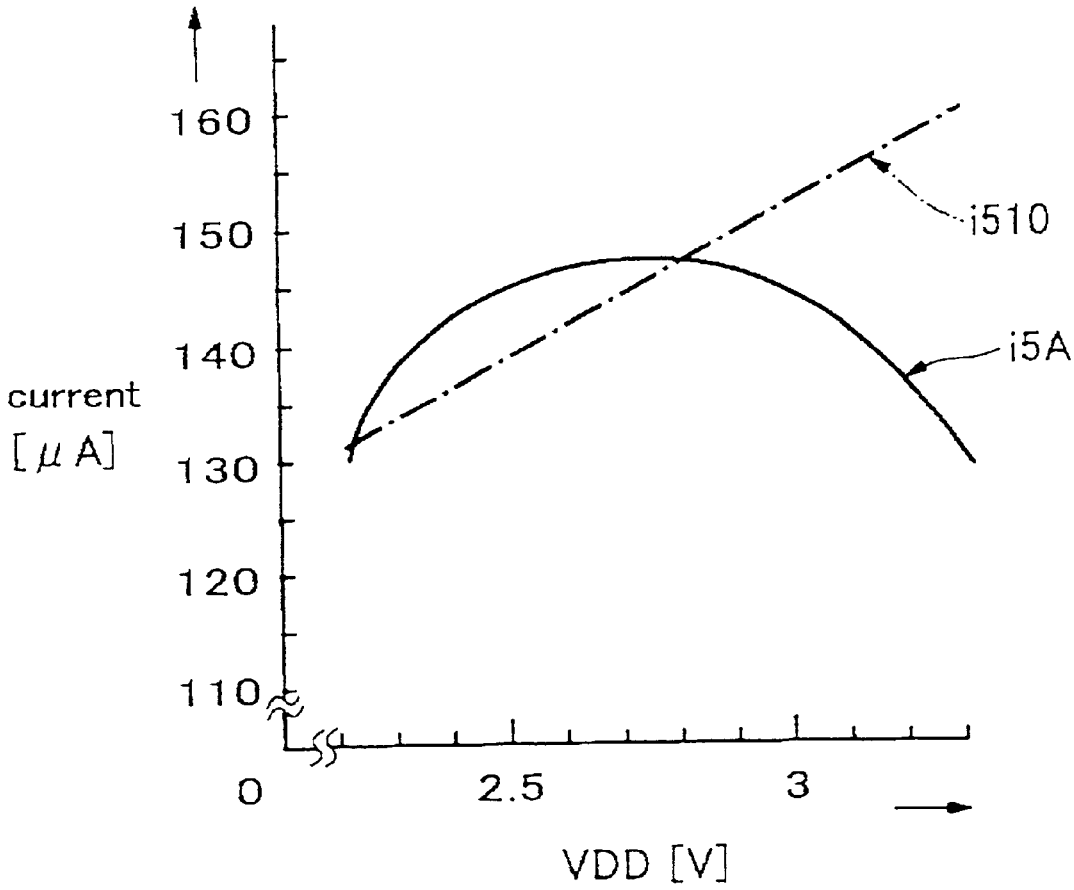
FIG. 7 is a graph for comparison of the circuit of FIG. 4 and the conventional circuit of FIG. 19, wherein the horizontal axis shows values of the power source potential VDD with a wider scale than that of FIG. 6, and the vertical axis shows values of currents in the circuits of FIGS. 4, 19.
Figure 18:
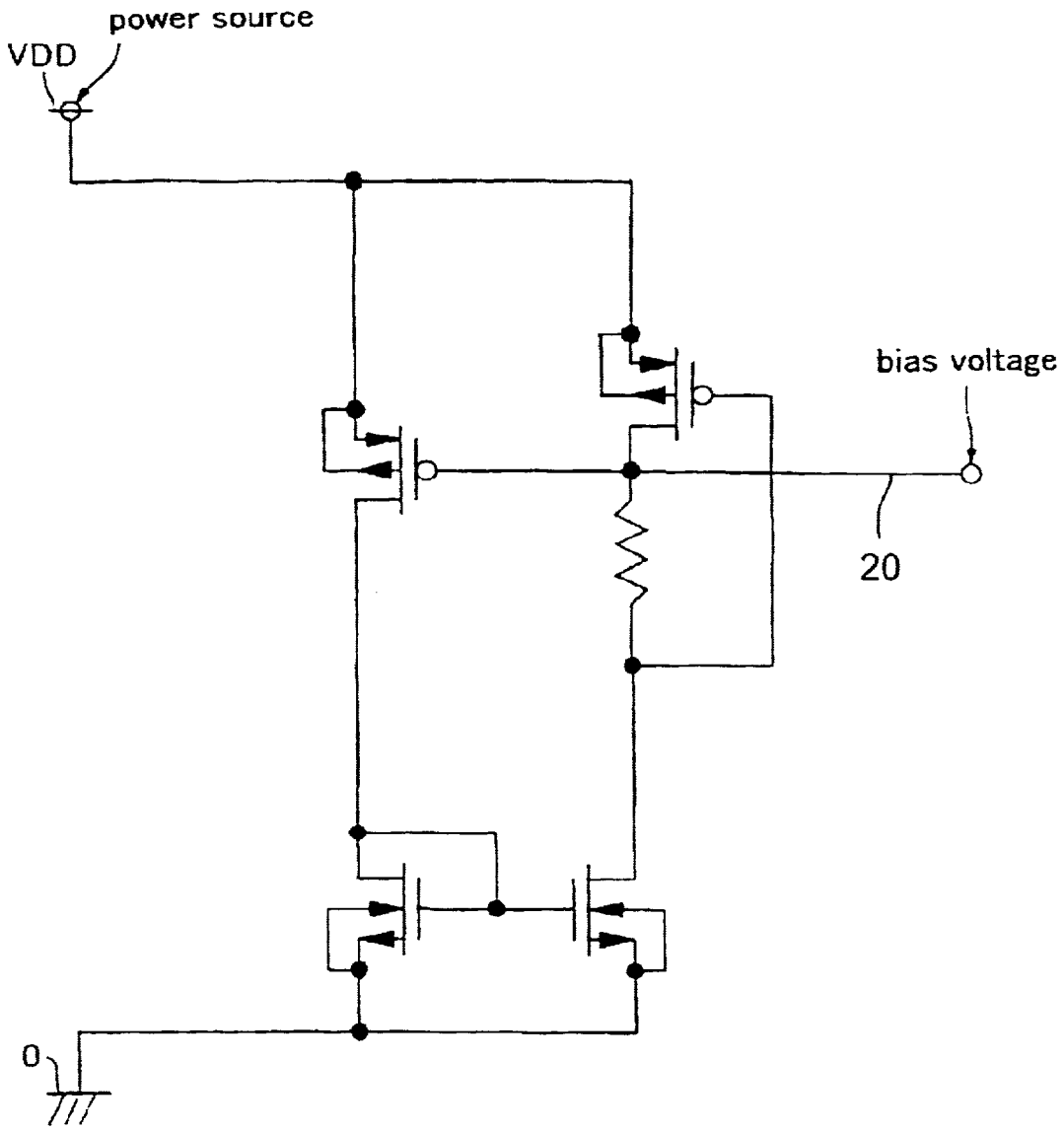
FIG. 18 is a conventional circuit diagram corresponding to FIG. 1.
Figure 19:
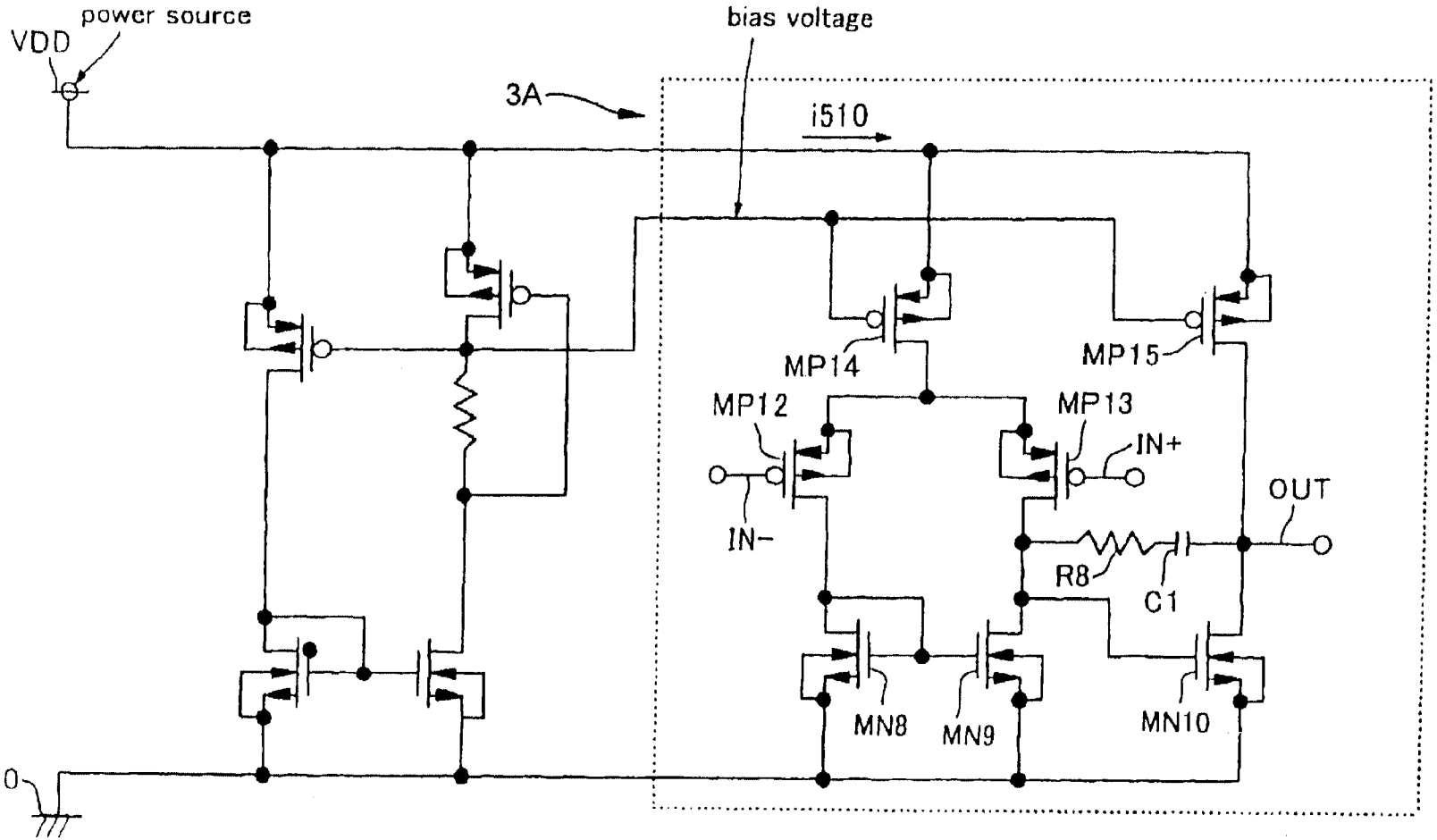
FIG.19 PRIOR ART
FIG. 19 is a conventional circuit diagram corresponding to FIG. 4.

For comparison purposes, FIG. 7 provides plots of circuit current i5A in the circuit in the embodiment of FIG. 4, and circuit current i510 when a conventional bias circuit (FIG. 18) is applied to the same operational amplifier 3A as shown in FIG. 19. Circuit current i510 in the conventional circuit of FIG. 19 increases with an increase in power source potential VDD linearly. However, in the circuit of FIG. 4 according to the embodiment, circuit current i5A has the trait that it goes up first and later down with an increase in the power source potential VDD, which is effective in reducing a current fluctuation range.

Figure 8:
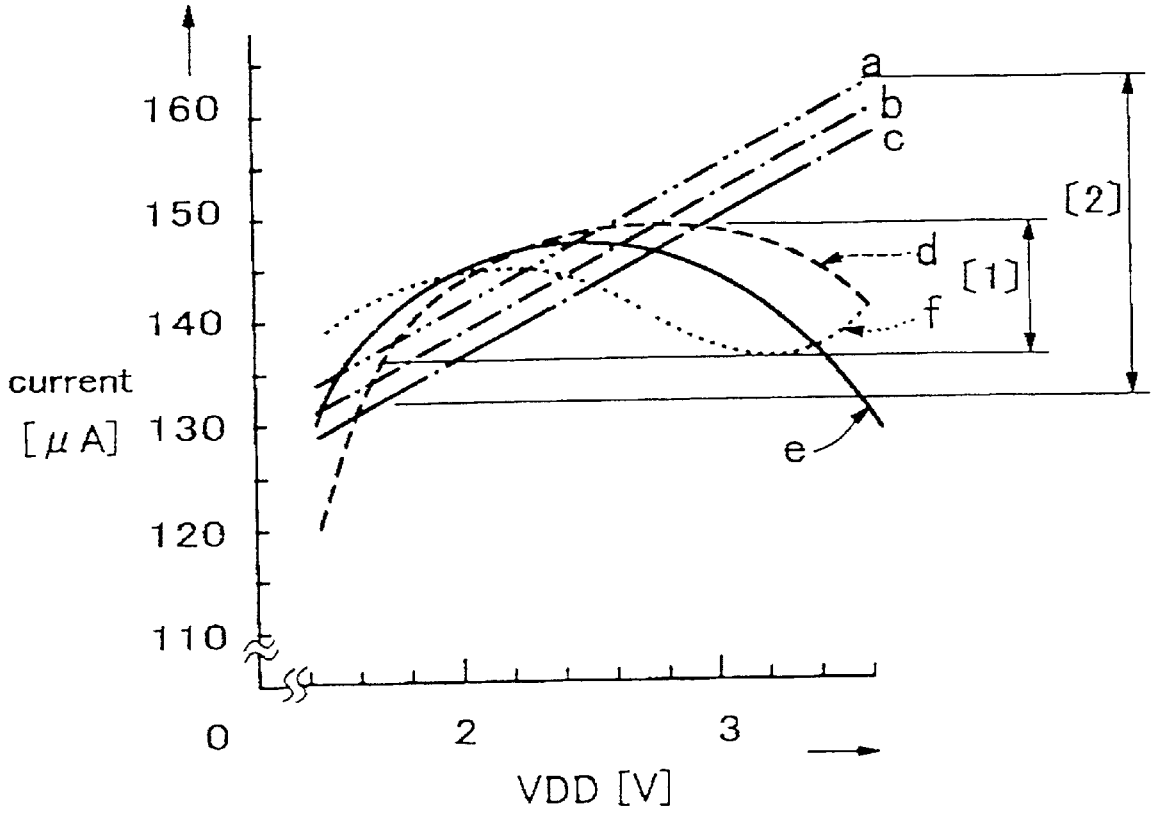
FIG. 8 is a graph for comparison of the circuit of FIG. 4 and the conventional circuit of FIG. 19, wherein the horizontal axis shows values of the power source potential VDD with a wider scale than that of FIG. 6, and the vertical axis shows values of currents in the circuits of FIGS. 4, 19 when the transistor thresholds Vths of respective circuits fluctuate.

For comparison of changes when the transistor threshold Vth fluctuates, FIG. 8 provides plots of circuit current i5A in the circuit of FIG. 4 according to the embodiment, and circuit current i510 when a conventional bias circuit (FIG. 18) is applied to the same operational amplifier 3A as shown in FIG. 19. In FIG. 8, a shows current i510 when the P-channel transistor threshold Vth shifts upward (the N-channel transistor threshold Vth shifts downward); b shows current i510 when the P-channel transistor threshold Vth is at the target value (the N-channel transistor threshold vth is at the target value); c shows current i510 when the P-channel transistor threshold Vth shifts downward (the N-channel transistor threshold Vth shifts upward); d shows current i5A when the P-channel transistor threshold Vth shifts upward (the N-channel transistor threshold Vth shifts downward); e shows current i5A when the P-channel transistor threshold Vth is at the target value (the N-channel transistor threshold Vth is at the target value); and f shows current i5A when the P-channel transistor threshold Vth shifts downward (the N-channel transistor threshold Vth shifts upward). When the transistor thresholds Vths fluctuate, [1] is a fluctuation range of current i5A in the circuit according to the embodiment and [2] is a fluctuation range of current i510 in the conventional circuit of FIG. 19 to compare those ranges. Then, it is shown that [1], a fluctuation range of current i5A in the circuit of FIG. 4 according to the embodiment, is smaller than [2], a fluctuation range of current i510 in the conventional circuit of FIG. 19. Circuit current i5A according to the embodiment of FIG. 4 is different from circuit current i510 in the conventional circuit of FIG. 19 in that the former current converges.

Figure 9:
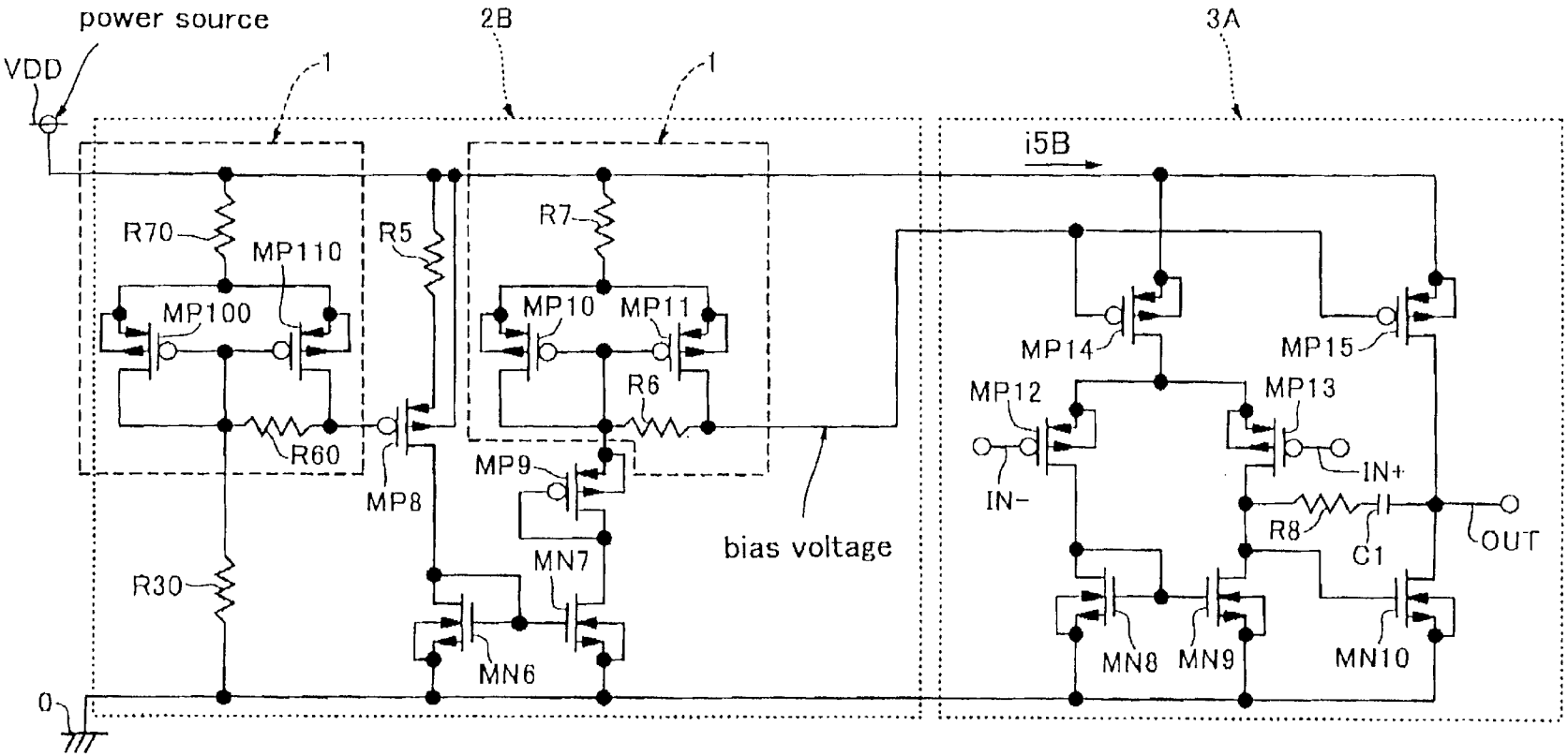
FIG. 9 is a circuit diagram according to another preferred embodiment of the invention.

FIG. 9 shows the second preferred embodiment of the invention in the form of a current control circuit, wherein the same part or component as in the circuit of FIG. 4 is designated by the same reference numeral as that of FIG. 4 in the interest of simplicity. In a bias circuit 2B of FIG. 9 according to the embodiment, the effect is enhanced by using a bias voltage produced by connecting two circuits 1 according to the embodiment shown in FIG. 1. In other words, the resistors R3, R4 in the circuit of FIG. 4 are replaced with the circuit 1 of FIG. 1. More specifically, a first resistor R70 is connected to the power source potential VDD at one terminal thereof, and at the other terminal connected to the sources of first and second P-channel field-effect transistors MP100 and MP110. In addition, gates of the first and second P-channel field-effect transistors MP100, MP110 are coupled together. The drain of the first P-channel field-effect transistor MP100 is directly connected to the mutually coupled gates of both the P-channel field-effect transistors MP100, MP110. The drain of the second P-channel field-effect transistor MP110 is connected through a second resistor R60 to the mutually coupled gates of the first and second P-channel field-effect transistors MP100, MP110, and also connected to the gate of a P-channel transistor MP8. The mutually coupled gates of the first and second P-channel field-effect transistors MP100, MP110 are connected through a resistor element R30 to the zero potential 0.

More specifically, current passing through the P-channel transistor MP8 that receives a driving voltage from the first-stage circuit 1 is duplicated by a current mirror circuit composed of N-channel transistors MN6, MN7 to a P-channel transistor MP9, whereby the first-stage circuit 1 is coupled to the second-stage circuit 1. Current flowing through the first-stage circuit 1 thus controls current in the second-stage circuit to reduce the source voltage dependence of circuit current.

Figure 10:
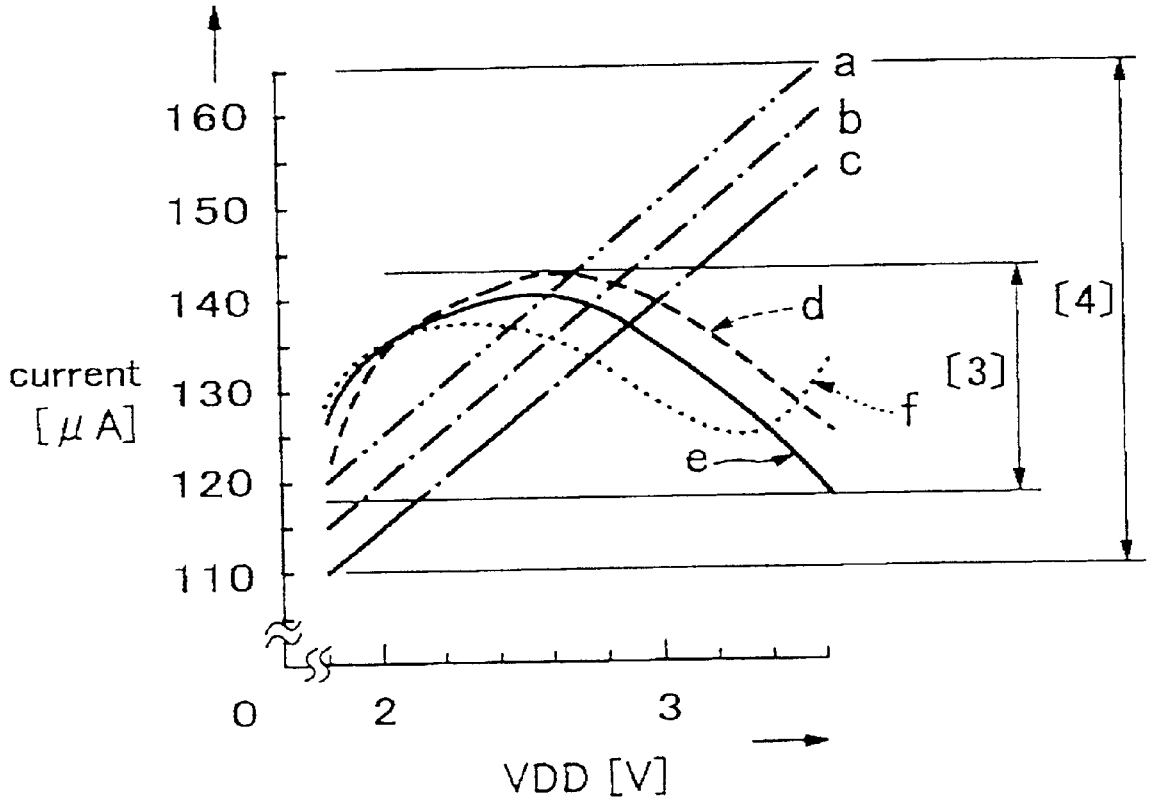
FIG. 10 is a graph for comparison of the circuit of FIG. 9 and the conventional circuit of FIG. 19, wherein the horizontal axis shows values of the power source potential VDD with a wider scale than that of FIG. 6, and the vertical axis shows values of currents in the circuits of FIGS. 9, 19 when the transistor thresholds Vths of respective circuits fluctuate.

For comparison of changes when the transistor threshold Vth fluctuates, FIG. 10 provides plots of circuit current i5B in the circuit of FIG. 9 according to the embodiment, and circuit current i510 when a conventional bias circuit (FIG. 18) is applied to the same operational amplifier 3A as shown in FIG. 19. In FIG. 10, a shows current i510 when the P-channel transistor threshold Vth shifts upward (the N-channel transistor threshold Vth shifts downward); b shows current i510 when the P-channel transistor threshold Vth is at the target value (the N-channel transistor threshold Vth is at the target value); c shows current i510 when the P-channel transistor threshold Vth shifts downward (the N-channel transistor threshold Vth shifts upward); d shows current i5B when the P-channel transistor threshold Vth shifts upward (the N-channel transistor threshold Vth shifts downward); e shows current i5B when the P-channel transistor threshold Vth is at the target value (the N-channel transistor threshold Vth is at the target value); and f shows current i5B when the P-channel transistor threshold Vth shifts downward (the N-channel transistor threshold Vth shifts upward). When the transistor thresholds Vths fluctuate, [3] is a fluctuation range of current i5B in the circuit according to the embodiment and [4] is a fluctuation range of current i510 in the conventional circuit of FIG. 19 to compare those ranges. Then, it is shown that [3], a fluctuation range of current i5B in the circuit of FIG. 9 according to the embodiment, is smaller than [4], a fluctuation range of current i510 in the conventional circuit. Furthermore, as shown by comparison of FIG. 8 and FIG. 10, circuit current i5B in the embodiment of FIG. 9 has the advantageous effect that a circuit current fluctuation range thereof is reduced in a wider range of power source potential VDD relative to circuit current i5A in the embodiment of FIG. 4.

Figure 11:
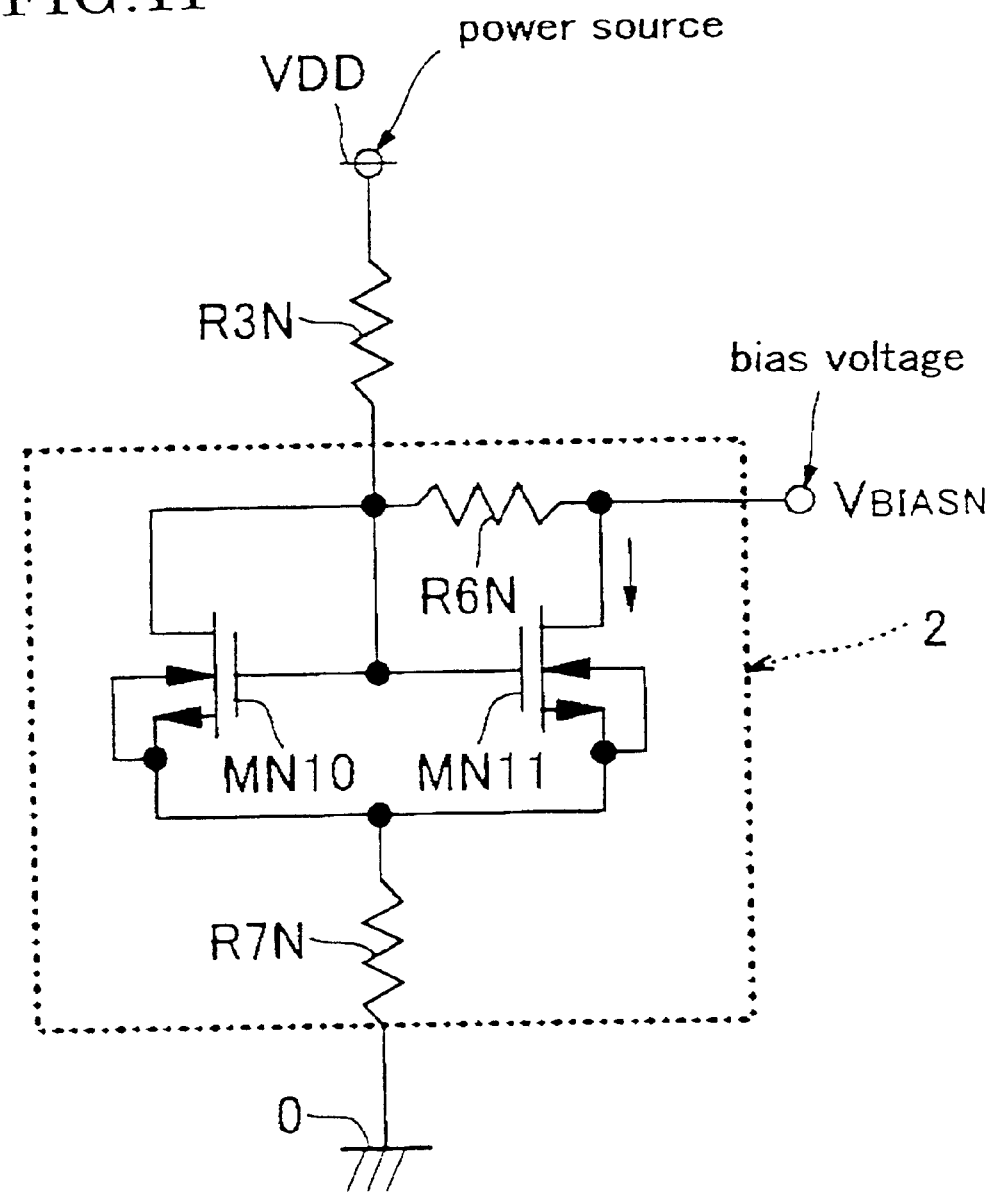
FIG. 11 is a circuit diagram of a current control circuit according to another embodiment of the invention wherein an opposite conductivity type substrate from that of FIG. 1 is used.

FIG. 11 shows another preferred embodiment of the invention in the form of a current control circuit wherein an N-type substrate is used. The circuit of FIG. 11 corresponds to the circuit 1 in a first embodiment of FIG. 1 wherein a P-type substrate is used. In FIG. 11, VDD shows a power source potential provided by an electric source such as a battery; and 0 shows a zero potential. The current control circuit according to the embodiment is placed between the power source potential VDD and zero potential 0. The current control circuit 2 in this embodiment has a resistor element R3N with one end thereof connected to the power source potential VDD, and first and second N-channel field-effect transistors MN10 and MN11, each of which has the gate coupled to the other end of the resistor element R3N and connected to the other gate.

The other end of the resistor element R3N opposite from the end connected to the power source potential VDD is directly connected to the drain of the first N-channel field-effect transistor MN10 and to the mutually coupled gates of the first and second N-channel field-effect transistors MN10, MN11. The drain of the second N-channel field-effect transistor MN11 is connected to a second resistor R6N, through the second resistor R6N to the mutually coupled gates of the first and second N-channel field-effect transistors MN10, MN11, and to the other end of the resistor element R3N opposite from the end connected to the power source potential VDD. The sources of the first and second N-channel field-effect transistors MN10, MN11 are coupled together, and through a first resistor element R7N to the zero potential.

A voltage $V_{BIASN}$ arising at the drain of the second N-channel field-effect transistor MN11 is used as a bias potential, whereby a current control circuit having constant current characteristics over a wide range of power source voltages can be produced.

Figure 12:
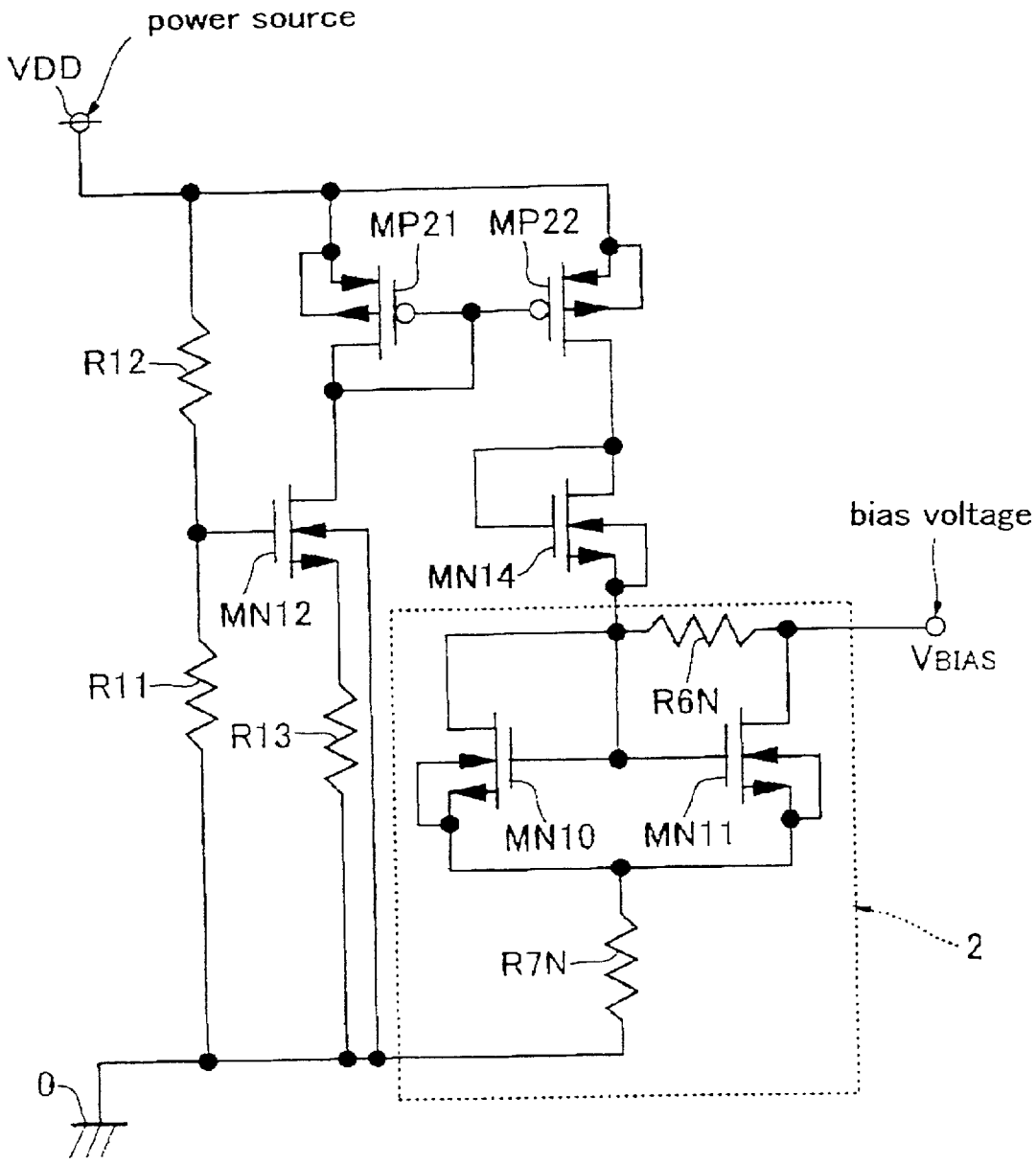
FIG. 12 is a circuit diagram of an application circuit of the circuit of FIG. 11 according to another embodiment of the invention.

FIG. 12 shows an application circuit of the current control circuit 2 in the embodiment of FIG. 11. The circuit of FIG. 12 corresponds to the circuit in the embodiment of FIG. 2 wherein a P-type substrate is used. The resistor element R3N of FIG. 11 is replaced with an N-channel field-effect transistor MN14 with the gate and the drain connected together and a P-channel field-effect transistor MP22 placed in series. In addition, a resistor R3, an N-channel field-effect transistor MN12, and a P-channel field-effect transistor MP21 are connected in series and placed between the zero potential 0 and the power source potential VDD. The gate of the N-channel transistor MN12 is connected to the midpoint node between resistors R11 and R2 placed in series between the zero potential 0 and the power source potential VDD, and the gate of the P-channel transistor MP21 with the gate and drain connected together is connected to the gate of the P-channel field-effect transistor MP22.

Figure 13:
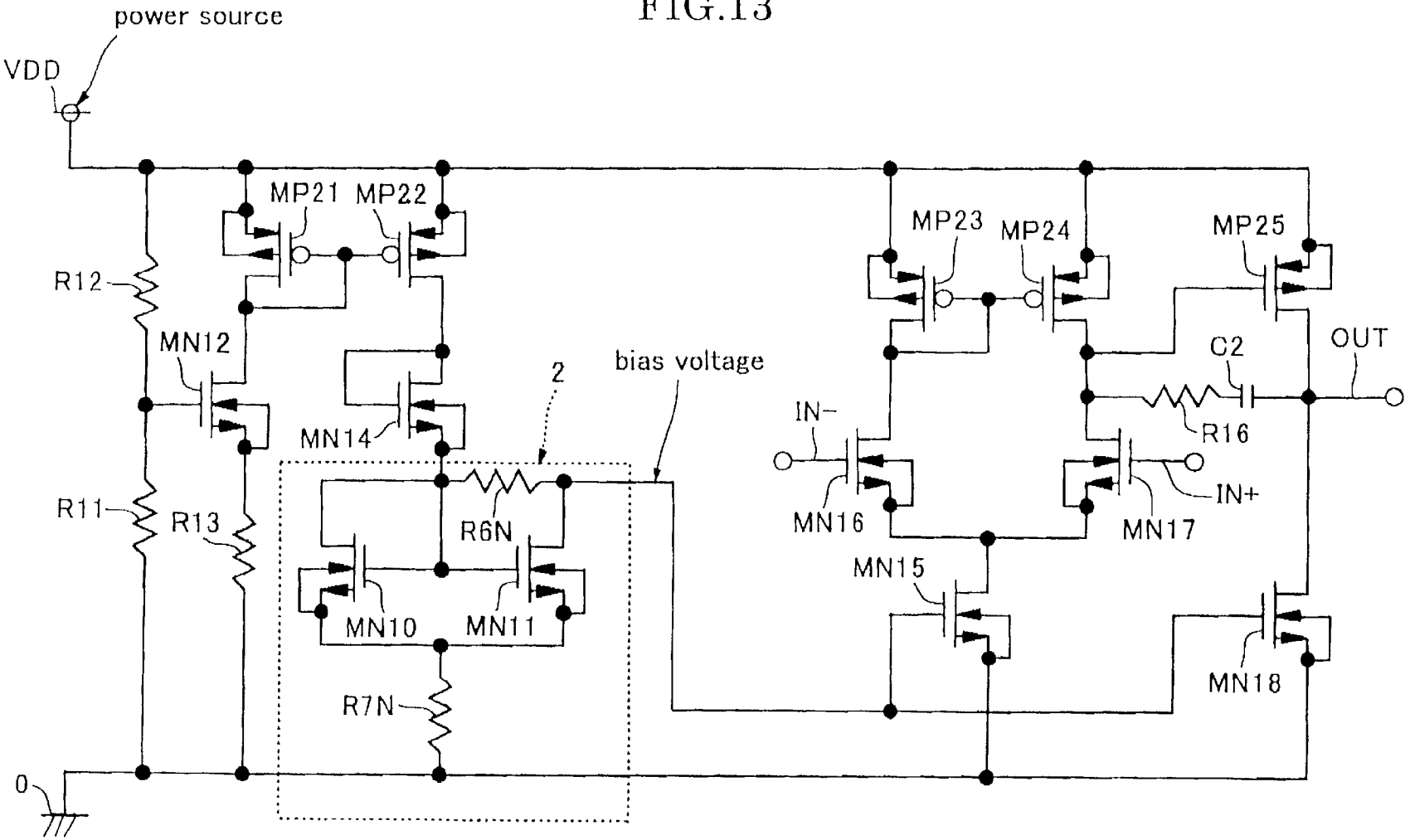
FIG. 13 is a circuit diagram of an application circuit of the circuit of FIG. 12 according to another embodiment of the invention.

FIG. 13 shows a combination of the bias circuit 2 in the embodiment of FIG. 12 and an operational amplifier circuit, which corresponds to the circuit in embodiment of FIG. 4 wherein a P-type substrate is used. More specifically, the bias voltage output from the bias circuit 2 of FIG. 12 is coupled to the gates of two N-channel field-effect transistors MN15, MN18. The sources of the two N-channel field-effect transistors MN15, MN18 are connected to the zero potential 0. The drain of the N-channel field-effect transistor MN15 is connected to the sources of a pair of N-channel field-effect transistors MN16, MN17. The cold input terminal of the operational amplifier is formed on the gate of the N-channel field-effect transistor MN16, and the hot input terminal of the operational amplifier is formed on the gate of the N-channel field-effect transistor MN17. The drain of the N-channel field-effect transistor MN16 is connected to the drain of a P-channel field-effect transistor MP23 having the gate and the drain connected together. The drain of the N-channel field-effect transistor MN17 is connected to the drain of a P-channel field-effect transistor MP24. The gates of the P-channel field-effect transistors MP23, MP24 are coupled together, and their sources are connected to the power source potential VDD. On the other hand, the drain of the N-channel field-effect transistor MN18 is connected to the drain of a P-channel field-effect transistor MP25. In addition, the P-channel field-effect transistor MP25 has the source connected to the source potential VDD and the gate connected to the drain of the P-channel field-effect transistor MP24. The drain of the N-channel field-effect transistor MN18 is also connected to the drain of the P-channel field-effect transistor MP24 through a capacitor C2 and a resistor R6, and to the output terminal of the operational amplifier.

Figure 14:
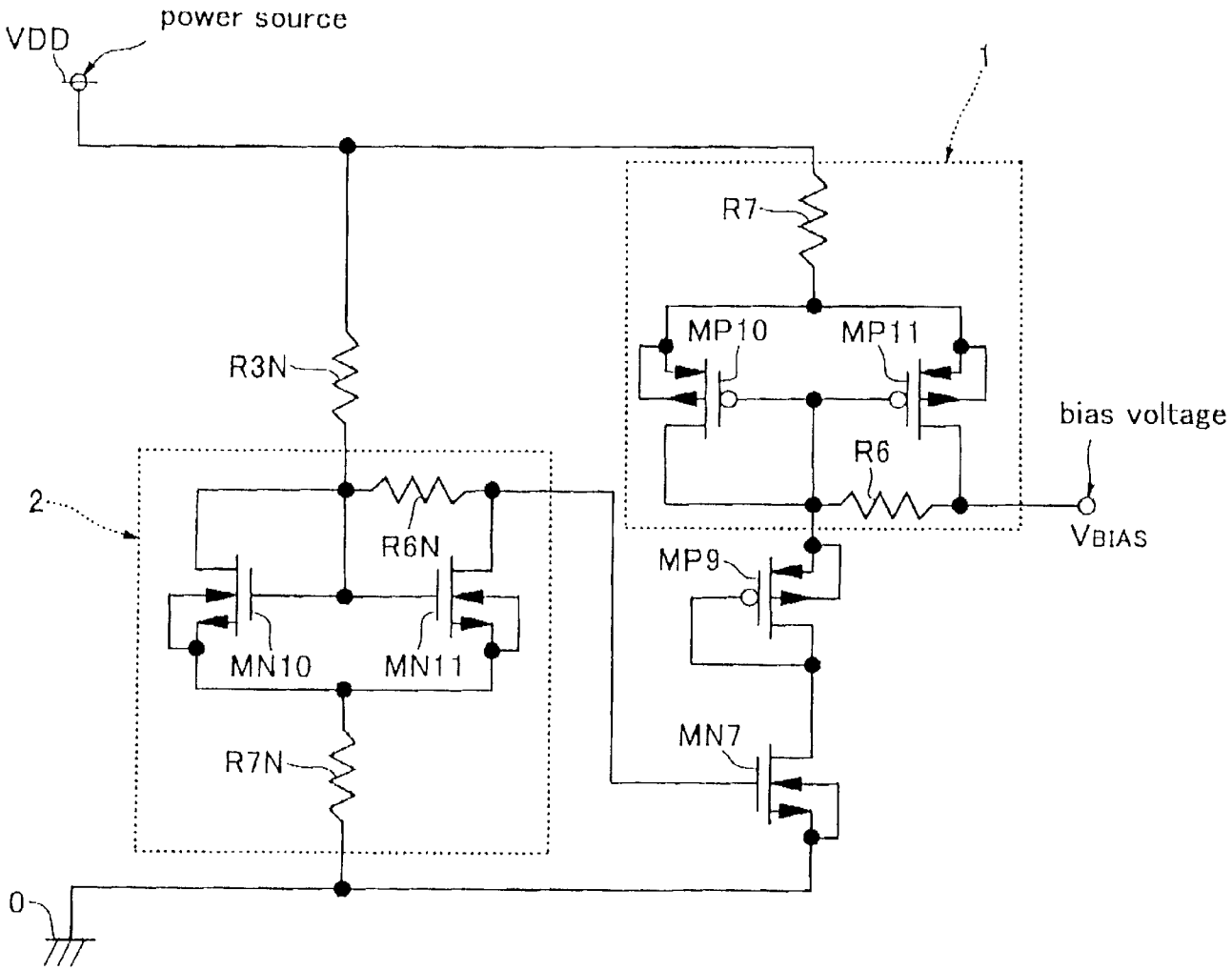
FIG. 14 is a circuit diagram of a combination of the circuits of FIGS. 1, 11 according to another embodiment of the invention.

FIG. 14 shows another embodiment according to the invention in the form of a circuit, which is a combination of the bias circuit 1 of FIG. 1 and the bias circuit 2 of FIG. 11. More specifically, a bias voltage output from the midpoint node between the second resistor R6N in the circuit 2 of FIG. 11 and the drain of the second N-channel field-effect transistor MN11 is coupled to the gate of an N-channel field-effect transistor MN7, and a P-channel field-effect transistor MP9 having the gate and drain connected together and the N-channel field-effect transistor MN7 are connected in series to form the resistor element R3P in the circuit 1 of FIG. 1.

Figure 15:
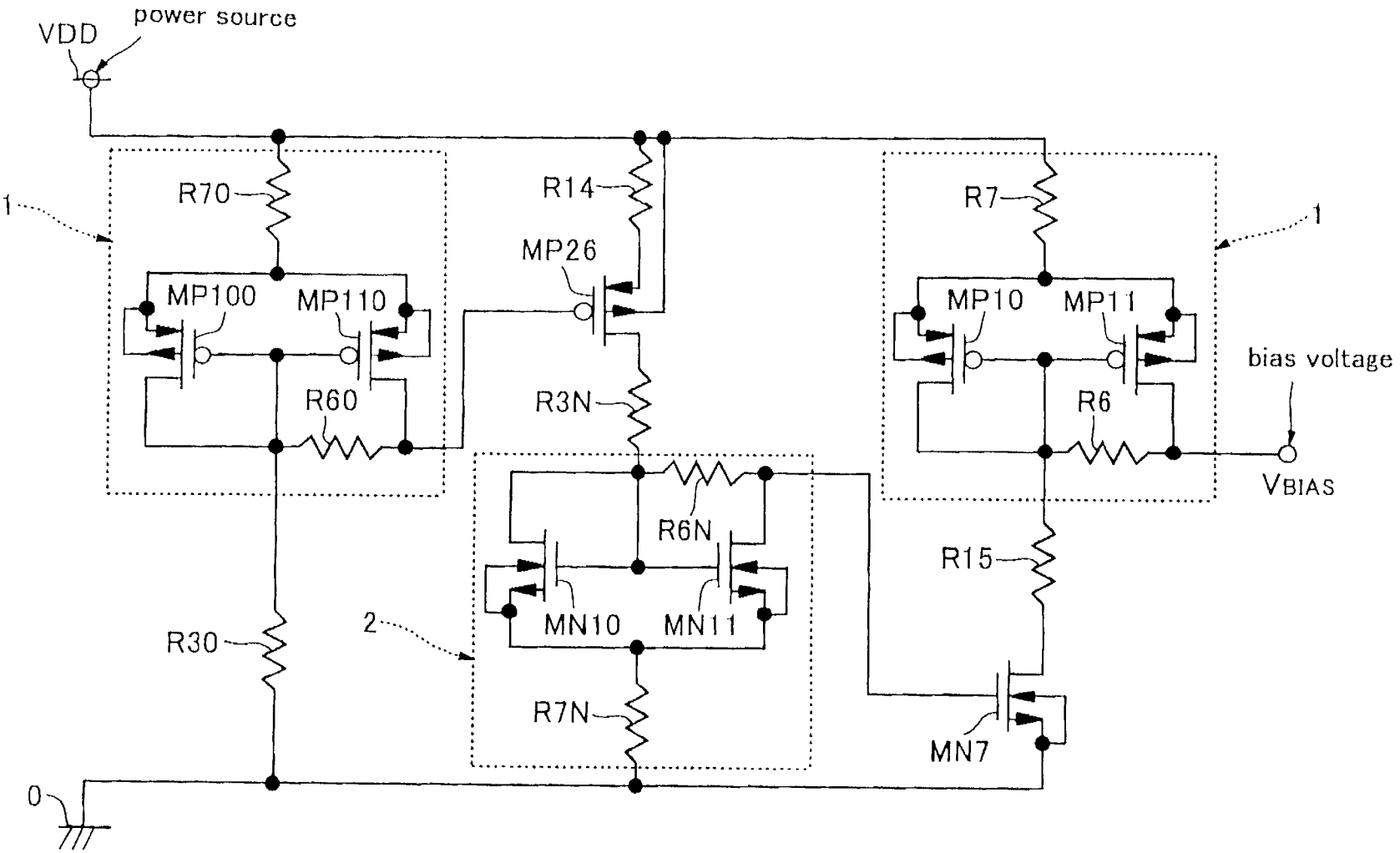
FIG. 15 is a circuit diagram of a combination of two circuits each consisting of the circuit of FIG. 1 and one circuit consisting of the circuit of FIG. 11 according to another embodiment of the invention.

FIG. 15 shows another embodiment according to the invention in the form of a circuit, which is a combination of the circuit of FIG. 1, the circuit 2 of FIG. 11, and the circuit of FIG. 1 in this order. More specifically, a bias voltage output from the circuit 1 of FIG. 1 arranged in the leftmost portion of FIG. 15 is applied to the gate of a P-channel field-effect transistor MP26 having the drain connected to the resistor element R3N in the circuit 2 of FIG. 11 arranged in the middle portion of FIG. 15. The source of the P-channel field-effect transistor MP26 is connected to the power source potential VDD through a resistor R4. A bias voltage output from the circuit 2 of FIG. 11 arranged in the middle portion of FIG. 15 is coupled to the gate of an N-channel field-effect transistor MN7 having the drain connected through a resistor element R5 to a second circuit consisting of the circuit 1 of FIG. 1 arranged in the right most portion of FIG. 15. Also, the N-channel field-effect transistor MN7 has the source connected to the zero potential 0. Therefore, a bias voltage is output from the output terminal of the second circuit consisting of the circuit 1 of FIG. 1 arranged in the rightmost portion of FIG. 15.

Although the invention has been described in its preferred embodiments with a certain degree of particularity, it is to be understood that various changes and modifications may be made in the invention without departing from the spirit and scope thereof.

What is claimed is:

1. A current control circuit for controlling a current flowing through a load circuit comprising:

a first resistor with one end connected to a power source potential;

first and second P-channel field-effect transistors, each of which having a source connected to another end of said first resistor and a gate coupled to a gate of the other P-channel field-effect transistor, said first P-channel field-effect transistor having a drain directly connected to both the gates coupled together;

a second resistor through which a drain of said second P-channel field-effect transistor is connected to both the gates coupled together; and a resistor element through which both the gates coupled together are connected to a zero potential, wherein a voltage arising at the drain of said second P-channel field-effect transistor is used as a gate-driving voltage for driving a gate of a current-setting transistor of said load circuit.

2. A combination of a plurality of said current control circuits according to claim 1, wherein:

said plurality of said current control circuits are disposed in successive stages ranging from stage 1 through stage N, wherein N is at least two;

said resistor element of each of said current control circuits of stages 2 to N is a part of said load circuit for said current control circuit of a prior stage of said stages and a current flowing through said resistor element is controlled by said voltage from said current control circuit of the prior stage; and said gate-driving voltage from said current control circuit of the stage N drives said current-setting transistor of said load circuit thereof which is outside said successive stages.

3. The combination according to claim 2 wherein said resistor element of each of said current control circuits of stages 2 to N comprises a transistor which is one of transistors constituting a current mirror circuit for duplicating a current flowing through said current-setting transistor which receives said gate-driving voltage from said current control circuit of the prior stage.

4. A current control circuit for controlling a current flowing through a load circuit comprising:

a first resistor with one end connected to a zero potential;

first and second N-channel field-effect transistors, each of which having a source connected to another end of said first resistor and a gate coupled to a gate of the other N-channel field-effect transistor, said first N-channel field-effect transistor having a drain directly connected to both the gates coupled together;

a second resistor through which a drain of said second N-channel field-effect transistor is connected to both the gates coupled together; and a resistor element through which both the gates coupled together are connected to a power source potential, wherein a voltage arising at the drain of said second N-channel field-effect transistor is used as a gate-driving voltage for driving a gate of a current-setting transistor of said load circuit.

5. A combination of a plurality of said the current control circuits according to claim 4, wherein:

said plurality of said current control circuits are disposed in successive stages ranging from stage 1 through stage N, wherein N is at least two;

said resistor element of each of said current control circuits of stages 2 to N is a part of said load circuit for said current control circuit of a prior stage of said stages and a current flowing through said resistor element is controlled by said voltage from said current control circuit of the prior stage; and said gate-driving voltage from said current control circuit of the stage N drives said current-setting transistor of said load circuit thereof which is outside said successive stages.

6. The combination according to claim 5 wherein said resistor element of each of said current control circuits of stages 2 to N comprises a transistor which is one of transistors constituting a current mirror circuit for duplicating a current flowing through said current-setting transistor which receives said gate-driving voltage from said current control circuit of the prior stage.

7. A combination of the current control circuits for driving a load circuit, comprising:

current control circuits including at least one first current control circuit and at least one second current control circuit;

each of said at least one first current control circuit including:

a first resistor with one end connected to a first power source potential;

first and second P-channel field-effect transistors, each of which having a source connected to another end of said first resistor and a gate coupled to a gate of the other P-channel field-effect transistor, said first P-channel field-effect transistor having a drain directly connected to both the gates coupled together;

a second resistor through which a drain of said second P-channel field-effect transistor is connected to both the gates coupled together; and a resistor element through which both the gates coupled together are connected to a second power source potential lower than said first power source potential, wherein a voltage arising at the drain of said second P-channel field-effect transistor is used as a gate-driving voltage for driving a gate of a current-setting transistor of said load circuit;

each of said at least one second current control circuit including:

a third resistor with one end connected to said second power source potential;

first and second N-channel field-effect transistors, each of which having a source connected to another end of said third resistor and a gate coupled to a gate of the other N-channel field-effect transistor, said first N-channel field-effect transistor having a drain directly connected to both the gates coupled together;

a fourth resistor through which a drain of said second N-channel field-effect transistor is connected to both the gates coupled together; and another resistor element through which both the gates coupled together are connected to said first power source potential, wherein a voltage arising at the drain of said second N-channel field-effect transistor is used as a gate-driving voltage for driving a gate of another current-setting transistor of said load circuit;

said first and second current control circuits being alternately disposed in successive stages ranging from stage 1 through stage N, wherein N is at least two;

said resistor element of each of stages 2 to N being a part of said load circuit for said current control circuit of a prior stage of said stages and a current flowing through said resistor element being controlled by said voltage from said current control circuit of the prior stage; and said gate-driving voltage from said current control circuit of the stage N driving said current-setting transistor of said load circuit thereof which is outside said successive stages.

8. The combination according to claim 7 wherein said resistor element of each of said current control circuits of stages 2 to N comprises a transistor which is one of transistors constituting a current mirror circuit for duplicating a current flowing through said current-setting transistor which receives said gate-driving voltage from said current control circuit of the prior stage.

* * * * *